United States Patent [19]

Oida et al.

[11] 4,405,904

[45] Sep. 20, 1983

[54] POWER CONTROL CIRCUIT FOR A MAGNETRON OSCILLATOR

[75] Inventors: Yoshio Oida, Funabashi; Masayuki Sasaki, Sagamihara; Hidetoshi Semi, Kamakura, all of Japan

[73] Assignee: Tokyo Shibaura Denki Kabushiki Kaisha, Kawasaki, Japan

[21] Appl. No.: 381,760

[22] Filed: May 25, 1982

Related U.S. Application Data

[63] Continuation-in-part of Ser. No. 217,845, Dec. 18, 1980, abandoned, which is a continuation of Ser. No. 70,125, Aug. 27, 1979, abandoned, which is a continuation of Ser. No. 928,868, Jul. 28, 1978, abandoned.

[30] Foreign Application Priority Data

Jul. 30, 1977 [JP] Japan ..... 52-91616

[51] Int. Cl.[3] ..... H05B 6/68

[52] U.S. Cl. ..... 331/87; 219/10.55 B; 315/106

[58] Field of Search ..... 307/252 B, 252 N, 252 UA; 219/10.55 B; 315/39.51, 101, 105, 106, 107; 331/86, 87

[56] References Cited

U.S. PATENT DOCUMENTS

| | | | |
|---|---|---|---|
| 3,735,237 | 5/1973 | Derby | 219/10.55 B |
| 3,939,319 | 2/1976 | Tamano et al. | 331/87 |
| 4,302,651 | 11/1981 | Wills | 219/10.55 B |

*Primary Examiner*—Siegfried H. Grimm
*Assistant Examiner*—S. V. Clark
*Attorney, Agent, or Firm*—Finnegan, Henderson, Farabow, Garrett & Dunner

[57] ABSTRACT

A zero-crossing signal is generated in response to the zero-crossing of the current of an AC power source of a magnetron oscillator, and in response to the zero-crossing signal a triac connected between the magnetron oscillator and the AC power source is turned on to generate a microwave. The triac is turned off when the voltage of the AC power source becomes lower than a holding voltage of the triac.

6 Claims, 3 Drawing Figures

POWER CONTROL CIRCUIT FOR A MAGNETRON OSCILLATOR

CROSS-REFERENCE TO THE RELATED APPLICATION

This application is a continuation-in-part of an abandoned application of Ser. No. 217,845 filed on Dec. 18, 1980 which is an abandoned continuation application of Ser. No. 70,125 filed on Aug. 27, 1979 which is an abandoned continuation application of Ser. No. 928,868 filed on July 28, 1978.

BACKGROUND OF THE INVENTION

This invention relates to microwave generators used for household electronic ovens and the like and, more particularly, to microwave generators having a function of controlling microwave energy supplied to an electronic oven.

In the prior art microwave generator, the microwave energy produced from a magnetron is controlled by detecting the phase in each cycle of, for instance, a 50-Hz commercial alternating current voltage and turning on an SCR inserted in a power source circuit for the magnetron. However, in such a microwave generator the magnetron is energized with a high voltage obtained by stepping up the same commercial alternating current voltage through a transformer, that is, in such a power control system based on the phase angle control the SCR is turned on at another phase then the zero phase of the source voltage. Therefore, the voltage supplied to the magnetron rises very sharply, thus giving rise to noise generation from a magnetron oscillation circuit.

SUMMARY OF THE INVENTION

An object of the invention, accordingly, is to provide a microwave generator, which is free from noise generation that might otherwise result from the control of microwave energy.

According to the invention, there is provided means for generating a zero-crossing trigger signal in response to the zero-crossing of input current supplied from an alternating current power source, an SCR turned on by said zero-crossing trigger signal, a switch element connected in series with the SCR to a direct current power supply, a switch element operating circuit for on-off operating said switch element according to a power control signal having a pulse width corresponding to the amount of power to be supplied, a circuit for turning on a triac inserted in a power source circuit for a magnetron when the SCR and switch element are turned on, and a magnetron oscillator energized by said power source circuit in response to the triggering of said triac.

DETAILED DESCRIPTION OF THE PREFERRED EMBODIMENT

Figure 1:
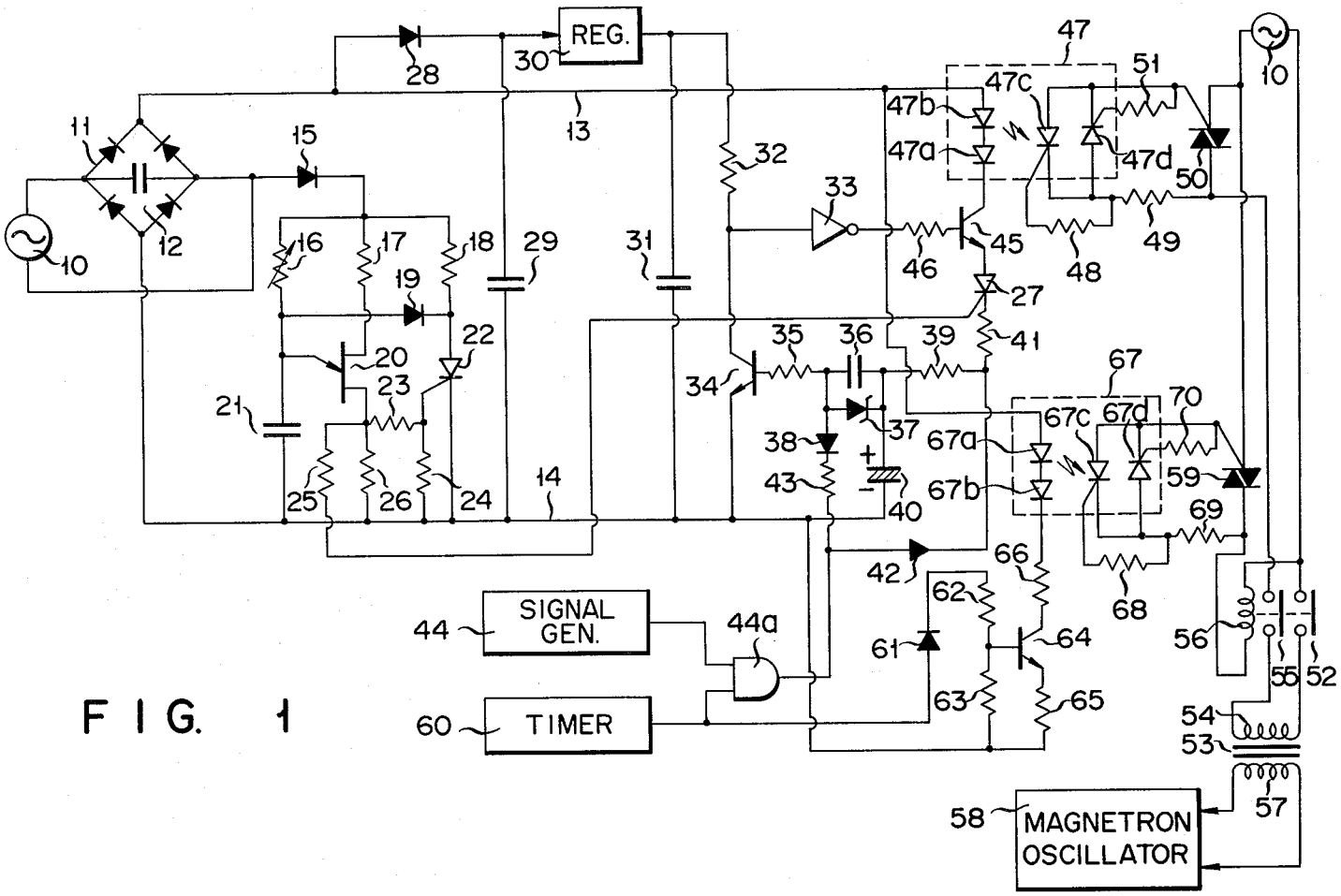
FIG. 1 is a circuit diagram showing one embodiment of the microwave generator according to the invention.

Now, one embodiment of the invention will be described in detail with reference to the accompanying drawings. Referring to FIG. 1, a 50-Hz/100-volt commercial alternating current power source 10 has its output terminals connected to respective alternating current input terminals of a full-wave rectifier 11 which is constituted by four diodes. A capacitor 12 is connected between the alternating current input terminals. A positive direct current output terminal of the full-wave rectifier 11 is connected to a positive line 13, while a negative direct current output terminal is connected to a negative line 14.

One of the alternating current input terminals of the full-wave rectifier 11 is connected to the anode of a diode 15, which has its cathode connected to one end of a variable resistor 16 and also to one end of each of resistors 17 and 18. The other end of the variable resistor 16 is connected to the anode of a diode 19, the emitter of a uni-junction transistor 20 and one end of a capacitor 21. The other end of the capacitor 21 is connected to the negative line 14. The cathode of the diode 19 is connected to the juncture between the other end of the resistor 18 and an anode of an SCR 22, and the cathode of the SCR 22 is connected to the negative line 14. The control gate of the SCR 22 is connected to the juncture between resistors 23 and 24, and the other end of the resistor 23 is connected to the juncture of one base of the uni-junction transistor 20 and resistors 25 and 26. The resistors 24 and 26 are connected at their other end to the negative line 14. The other base of the uni-junction transistor 20 is connected to the other end of the resistor 17. The other end of the resistor 25 is connected to the control gate of an SCR 27.

The positive direct current output terminal of the full-wave rectifier 11 is connected through a diode 28 to one end of a capacitor 29 and also to an input terminal of a regulator 30. The other end of the capacitor 29 is connected to the negative line 14 and the output terminal of the regulator 30 is connected to one end of a capacitor 31 and also to one end of a resistor 32. The other end of the capacitor 31 is connected to the negative line 14, and the other end of the resistor 32 is connected to an input terminal of an inverter 33 and also to the collector of a transistor 34. The transistor 34 has its emitter connected to the negative line 14 and its base connected to one end of a resistor 35. The other end of the resistor 35 is connected to one end of a capacitor 36, the anode of a zener diode 37 and the anode of a diode 38. The other end of the capacitor 36 is connected to one end of a resistor 39, one end of a capacitor 40 and the cathode of the zener diode 37. The other end of the resistor 39 is connected through a resistor 41 to the cathode of the SCR 27. The other end of the capacitor 40 is connected to the negative line 14. The juncture between resistors 39 and 41 is connected to the cathode of a diode 42, and the anode thereof is connected through a resistor 43 to the cathode of the diode 38 and also connected to an output end of an AND gate **44*a* which has one input connected to the output terminal of a signal generator 44**.

The anode of the SCR 27 is connected to the emitter of a transistor 45, which has its base connected through a resistor 46 to the output terminal of the inverter 33 and its collector connected through light-emitting elements (LED) **47*a* and 47*b* of a photo-coupler 47 to the positive line 13. Constituting light-receiving elements of the photo-coupler 47 are SCRs 47*c* and 47*d* connected in parallel and in opposite polarities. The control gate of the SCR 47*c* is connected through a resistor 48 to the juncture of the cathode of the SCR 47*c*, anode of the SCR 47*d* and one end of a resistor 49. The other end of the resistor 49 is connected to one end of a triac 50. The control gate of the triac 50 is connected to the juncture between the anode of the SCR 47***c* and cathode of the SCR 47*d*, and is also connected through a resistor 51 to the control gate of the SCR 47*d*.

The other end of the triac 50 is connected to one end of alternating current power source 10, the other end of which is connected through a relay switch 52 to one end of the primary winding 54 of a transformer 53. The other end of the primary winding 54 is connected through a relay switch 55 to the one end of the triac 50. The relay switches 52 and 55 are on-off operated by a relay coil 56 connected through a triac 59 to the alternating current power source 10. The secondary winding 57 of the transformer 53 is connected to input terminals of a magnetron oscillator 58. The magnetron oscillator 58 includes a magnetron and a drive circuit therefor, these being not shown, and when a high voltage is applied to it from the secondary winding 57 of the transformer 53, the magnetron is oscillated to generate a microwave at a predetermined frequency.

A magnetron operation period setting circuit for energizing the relay coil 56 according to the output of a timer 60 is connected between the positive and negative lines 13 and 14. The output terminal of the timer 60 is connected to the other input terminal of the AND gate 44*a* and also to the anode of a diode 61. The cathode of the diode 61 is connected through series resistors 62 and 63 to the negative line 14. The AND gate 44*a* is enabled by the output of the timer 60 to pass pulses from the signal generator 44. The juncture between the resistors 62 and 63 is connected to the base of a transistor 64, which has its emitter connected through a resistor 65 to the negative line 14 and its collector connected through a resistor 66 and LEDs 67*b* and 67*a* to the positive line 13.

The LEDs 67*a* and 67*b* are light-emitting elements of a photo-coupler 67, and light emitted from them is received by SCRs 67*c* and 67*d* serving as light-receiving elements. The SCRs 67*c* and 67*d* are connected in parallel and in opposite polarities, and the control gate of the SCR 67*c* is connected through a resistor 68 to the juncture of the SCRs 67*c* and 67*d* and resistor 69. The control gage of the SCR 67*d* is connected through a resistor 70 to the juncture of the SCRs 67*c* and 67*d* and the control gate of the triac 59.

Now, the operation of the embodiment of FIG. 1 will be described in detail with reference to FIGS. 2 and 3. It is assumed that the embodiment of FIG. 1 is applied to an electronic oven. The timer 60 is provided for setting a desired period T1 (shown at (a) in FIG. 2) for heating food. The signal generator 44 generates a plurality of pulses with a predetermined pulse width Td in one cycle period T2 as shown in (b) in FIG. 2 within the preset heating period T1. The AND gate 44*a* is held enabled for the period T1 of the output signal from the timer 60, and during this period it passes pulses from the signal generator 44 to the diode 42. The period of the output pulse of the signal generator 44 is T2, and the pulse width Td is set to a predetermined width within the period T2. In this embodiment, the periods mentioned above are set to T2=13 seconds, Td=6.5 seconds and T1=130 seconds. The magnetron in the magnetron oscillator 58 is repeatedly energized for the period of the pulse width Td during the period T1 to generate microwaves as will be described later in detail. Thus, the total amount of microwave energy that is generated within the period T1 can be controlled by varying the pulse width Td. Various signal generators which are constructed such that the pulse width Td can be varied are well known in the art, and no further description of the signal generator will be necessary.

The AC voltage at 50 Hz, in FIG. 1, is rectified by the full-wave rectifier 11 into a pulsating voltage which is smoothed through the capacitor 29 to a predetermined DC voltage applied to the input terminal of the regulator 30.

Figure 2:
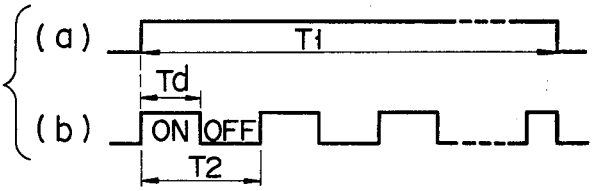
FIGS. 2 and 3 are timing charts for explaining the operation of the microwave generator shown in FIG. 1.

When the output pulse of the duration T1 as shown in (a) in FIG. 2 is generated from the timer 60, the transistor 64 is turned on in response to the rising of the timer output to cause DC current to pass through the LEDs 67*a* and 67*b* in the photo-coupler 67 between the lines 13 and 14. As a result, the SCRs 67*c* and 67*d* are turned on to turn on the triac 59. Thus, the relay coil 56 is energized by the AC power source 10 to close the relay switches 52 and 55. At this time, the triac 50 is still "off", and the magnetron oscillator 58 is not driven yet.

Figure 3:
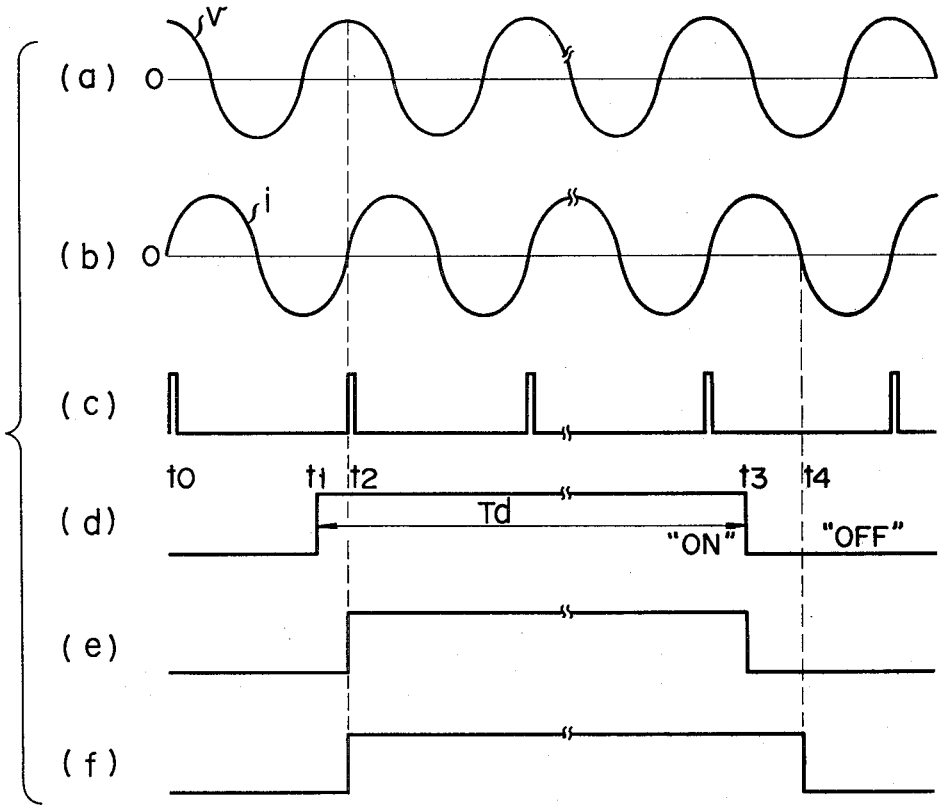

Meanwhile, the voltage v and current i of the AC power source 10 are substantially 90° out of phase with respect to one another as shown in (a) and (b) in FIG. 3, and the positive half-wave of the source voltage v is applied through the diode 15 to the juncture of the variable resistor 16 and resistors 17 and 18. By this positive half-wave voltage the capacitor 21 is charged, and the time constant for this charging can be adjusted by varying the resistance of the variable resistor 16. The resistance of the variable resistor 16 is thus adjusted such that the uni-junction transistor 20 is turned on at the peak of the positive half-wave voltage, i.e., at the instant of zero crossing of the source current i, as determined by the voltage developed across the capacitor 21. When the uni-junction transistor 20 is turned on, a zero-crossing trigger signal appears at an instant t0 as shown in (c) in FIG. 3 and is coupled through the resistor 25 to the control gate of the SCR 27. The trigger signal is also supplied through the resistors 23 and 24 to the control gate of the SCR 22. By this trigger signal the SCR 22 is turned on to cause discharge of the capacitor 21 through the diode 19 and SCR 22, and thus a pulse of a very narrow pulse width is supplied as zero-crossing trigger signal to the SCR 27. At the instant t0, however, the output of the signal generator 44 is still at low level ("off") as shown in (d) in FIG. 3. Thus, the transistor 45, and hence the SCR 27, remains "off", and the photo-coupler 47 is not operated.

When a pulse with pulse width Td appears from the pulse generator 44 at an instant t1, it is applied through the AND gate 44*a*, diode 42 and resistor 39 to the capacitor 40 to charge the capacitor 40. When the voltage developed across the capacitor 40 exceeds the zener voltage of the zener diode 37, the diode 37 is turned on to apply voltage to the base of the transistor 34, thus turning on the transistor 34. As a result, the input level of the inverter 33 is changed from a "high" to "low" level to change the output level of the inverter 33 from a "low" to "high" level, thus turning on the transistor 45.

When a subsequent instant t2 is reached in this state, the zero-crossing trigger signal is supplied to the control gate of the SCR 27 to turn on the SCR 27 as mentioned earlier. As a result, current is caused to flow from the positive line 13 to the LEDs 47*a* and 47*b* in the photo-coupler 47, and a trigger signal as shown in (e) in FIG. 3 is thus supplied to the control gate of the triac 50. Then the triac 50 is thus turned on, the output of the AC power source 10 is supplied through the two relay switches 52 and 55 which have already been closed and also through the transformer 53 to the magnetron oscillator 58, whereby the microwave is generated. The operation of the triac 50 is shown in (f) in FIG. 3.

When the output of the signal generator 44 goes to the "low" level at an instant t3, the capacitor 40 is discharged through the zener diode 37, diode 38 and resistor 43 to turn off the transistor 34. As a result, the input level of the inverter 33 is changed to the "high" level to turn off the transistor 45 so that the SCR 27 will remain "off" even if a trigger pulse will be applied to the control gate thereof. At the instant t3 the triac 50 remains "on" even with the vanishment of the trigger signal from the photo-coupler 47. More particularly, the triac 50 is held "on" until an instant t4 when the source voltage v becomes lower than the holding voltage of the triac 50 for the first time after the change of the output of the signal generator 44 to the "low" level at the instant t3. In the instant embodiment the triac 50 is turned off just at the instant of zero crossing of the source current i as shown in (b) and (f) in FIG. 3.

As has been shown, with the microwave generator according to the invention the turn-on or turn-off action, particularly the turn-on action, of a switch inserted between the magnetron oscillator and AC power source, in the above embodiment of FIG. 1 the triac 50, is effected at the instant of zero crossing of the current of the AC power source. It will thus be appreciated that since the turn-on or turn-off action of the microwave generator circuit is caused at the instant of zero crossing of the current of the AC power source, it is possible to prevent generation of impulse noise that might otherwise result due to the inductance in the microwave generator. The period during which the switch mentioned above is on is set to several cycles of the AC power source, and it can be freely adjusted to control the total amount of microwave energy generated within the heating period set by the timer.

What we claim is:

1. A microwave generator comprising means for generating a zero-crossing trigger signal in response to input current supplied from an alternating current power source, an SCR turned on by said zero-crossing trigger signal, a first switch element connected in series with said SCR across a direct current power supply, means for generating a power control signal having a pulse width corresponding to an amount of power to be supplied, a first switch element operating circuit for on-off operating said first switch element according to said power control signal, a magnetron oscillator, a second switch element inserted between the magnetron oscillator and alternating current power source, a second switch element operating circuit for turning on said second switch element when said SCR and first switch element are turned on.

2. The microwave generator according to claim 1, wherein said means for generating said zero-crossing trigger signal includes a CR time constant circuit having a variable resistor and a capacitor and supplied with a positive half-wave voltage of the alternating current power source, a uni-junction transistor triggered by a predetermined terminal voltage developed across said capacitor, and a circuit for generating a zero-crossing trigger signal in response to the triggering of said uni-junction transistor.

3. The microwave generator according to claim 1, wherein said first switch element operating circuit includes a capacitor charged by said power control signal, a transistor turned on in response to the charging of said capacitor to a predetermined level, and means for turning on said first switch element in response to the turning-on of said transistor.

4. The microwave generator according to claim 3, wherein said first switch element operating circuit further includes means for causing discharge of said capacitor in response to a level fall of said power control signal and said transistor is turned off with the discharge of said capacitor.

5. The microwave generator according to claim 1, wherein said second switch element operating circuit includes a photo-coupler energized at an instant when said SCR and first switch element are turned on and means for turning on said second switch element according to the output of said photo-coupler.

6. The microwave generator according to claim 1, which further comprises a timer for generating an output signal for setting the period of heating with microwave, a transistor turned on in response to the output signal from said timer, a photo-coupler energized when said transistor is turned on, a triac turned on according to the output of said photo-coupler, a relay coil energized in response to the turning-on of said triac, a relay switch closed when said relay coil is energized, and means for connecting said relay switch in series with said second switch element between said magnetron oscillator and alternating current power source.

* * * * *